United States Patent [19]

Sack et al.

[11] 4,364,971

[45] Dec. 21, 1982

[54] WATERPROOF PHOTOGRAPHIC PAPER AND METHOD OF PRODUCING SAME

[75] Inventors: Wieland Sack, Bissendorf; Reiner Anthonsen, Bramsche; Ferenc Kertesz, Bissendorf, all of Fed. Rep. of Germany

[73] Assignee: Felix Schoeller, Jr. GmbH & Co., Fed. Rep. of Germany

[21] Appl. No.: 273,110

[22] Filed: Jun. 12, 1981

[30] Foreign Application Priority Data

Jun. 18, 1980 [DE] Fed. Rep. of Germany ..... 3022709

[51] Int. Cl.[3] ..... B05D 3/06

[52] U.S. Cl. ..... 427/44; 427/362

[58] Field of Search ..... 427/44, 362

[56] References Cited

U.S. PATENT DOCUMENTS

| | | | |
|---|---|---|---|
| 3,658,620 | 4/1972 | Hall | 428/482 |
| 4,113,894 | 9/1978 | Koch | 427/44 |
| 4,265,969 | 5/1981 | Yasuda et al. | 427/44 |
| 4,289,821 | 9/1981 | Gray et al. | 427/44 |
| 4,301,210 | 11/1981 | Yasuda et al. | 427/44 |

*Primary Examiner*—John H. Newsome

*Attorney, Agent, or Firm*—Allegretti, Newitt, Witcoff & McAndrews, Ltd.

[57] ABSTRACT

A method for producing a waterproof paper support having a photographic emulsion which is characterized by a highly plane surface which includes the steps of coating one side of the paper with a pigmented resin hardenable by radiation, pressing the resin surface against a highly polished surface such as the surface of a chrome-plated drum and then separating the hardened product from the polished surface.

13 Claims, 2 Drawing Figures

WATERPROOF PHOTOGRAPHIC PAPER AND METHOD OF PRODUCING SAME

This invention relates to a photographic paper and to a method of producing a photographic paper, especially a method of producing a waterproof-coated paper support for photographic coatings.

PRIOR ART

Waterproof photographic papers consist, according to German Pat. No. 1 447 815, of a paper support, with synthetic resin films extruded onto both faces and one or more photosensitive coatings containing silver salt on one of the synthetic resin surfaces. The photosensitive coatings may involve black-and-white or indeed color photographic coatings. The synthetic resin layer disposed beneath the photographic coatings usually contains light-reflecting white pigment, for example titanium dioxide, and also possibly shading dyes (graduating dyes) and/or optical brighteners. The content of white pigment usually amounts to 8 to 15% of the synthetic resin, which preferably is polyethylene.

Other waterproof photographic support papers have already been described earlier (e.g. Canadian Pat. No. 476 691). These consist of a paper support, which consists on one side of a pigment coating based upon barium sulphate and of a synthetic resin coating disposed thereon. Also, papers coated with pigment-containing lacquers have long been known as waterproof supports for photographic coatings (German Pat. No. 912 173). It is possible here, by special selection of the pigments, to reduce the porosity of the coating and improve the reflection of the visible light.

The surface of the photographic papers waterproof-coated according to known methods with thermoplastics materials is usually shaped with rollers by the application of pressure. This is carried out, for example, in the extrusion coating of paper with polyethylene in a so-called laminator, but can also be carried out in a separate operation by means of glazing rolls (calendars). In addition, a special method is described in DOS No. 2,250,063, which is intended to produce by means of heated glazing rolls (30° to 200° C.) with simultaneous application of pressure, an especially smooth synthetic resin surface.

Modern photographic substrates, especially those intended for color photography, require an extremely high surface quality (glaze) on account of the large number of superimposed, very thin photographic coatings. This high glaze is necessary because even slight irregularities (pitting or graining) of the surfaces can lead to differences in thickness of the photographic coatings and thus to color distortions, varying depth of color and lack of definition in the image. This applies especially to color diffusion transfer processes (instant image photography) and for the silver color bleaching process, because in both cases diffusion processes with their dependence upon time and distance are decisive for the quality of the image.

A disadvantage in all the hitherto known processes for the production of paper supports for photographic purposes is that the surfce quality desired for some processes cannot be achieved with any of the known paper coating and aftertreatment processes. There are various reasons for this. In the case of the use of swelling liquids (solvents), their removal is accompanied by deformation of the paper. In the case of the application of pressure the elasticity of the paper fiber mat, after the pressure has been removed, causes a partial restoration of the preceding state. In the case of a thermoplastic coating the non-uniform adhesion of the thermoplastic to the smoothing roll when pressure is used leads to a specific unevenness of the surface which forms when the paper is removed.

On account of these hitherto unavoidable defects in the surface quality when coating paper, pigmented plastic foil is used for various photographic applications, for example as supports for silver color bleach coatings or as supports in color instant image photography. If these are cast foils (e.g. of cellulose triacetate), their production is naturally accompanied by all the disadvantages in the use and recovery of volatile solvents.

Another serious disadvantage of foils is the limited possibility of pigmentation imposed by their production process. In particular polyester foils produced by extrusion from the melt can absorb pigments to only a very limited extent (less than 10%). If higher pigment quantities are employed, then during the extrusion and especially at the subsequent two-dimensional stretching of the film, faults in the film structure result, which have an adverse influence upon the satisfactory application of photographic coatings and appear as a cloudy disturbance in the developed photographic image. Higher white pigment contents are, however, desirable in the interests of optimum image definition.

In respect of their mechanical properties also, film supports are not ideal. For equivalent thickness, they are relatively stiff and bulky and have a tendency to curl as a result of atmospheric conditions to a greater extent than coated papers.

In British Pat. No. 1 111 913, a paper coated with polyethylene on both sides is indeed claimed as a suitable substrate for color photography coatings according to the silver color bleach process. There has actually been no success so far in producing a paper coated in accordance with the requirements of this process, because the surface quality is not adequate. The same applies also for colored instant image photography.

It has been proposed to cure a resin laminate in contact with a controlled gloss surface for use in furniture construction (U.S. Pat. No. 4,113,894). The treatment imparts a simulated hand-rubbed finish to the cured surface of the laminate. But achieving a glossy surface is quite different from achieving a plane surface approaching that of a flat mirror of polished glass.

THE INVENTION

The object of the present invention therefore is to create a waterproof photographic support material on a paper base which overcomes the disadvantages of the known coated paper supports and approaches the quality of film supports in respect of its surface quality without possessing their disadvantages. This object is achieved in that a pigment-containing mixture that can be hardened by radiation is first applied in known manner onto a sized photographic base paper and smoothed. This coating is then pressed using only light pressure against a highly polished surface, is solidified during contact with the forming surface by accelerated electron radiation from the rear face of the paper and subsequently removed from the forming surface. The application of light pressure is intended here to mean a pressure that is sufficient for assuring bubble-free contact between the coating and the forming surface. In the case where the process is carried out using a highly polished cylinder, the usual paper stress, for example of the order of 10–1000 g/cm (preferably 100–500 g/cm) is sufficient.

THE DRAWINGS

Figure 1:
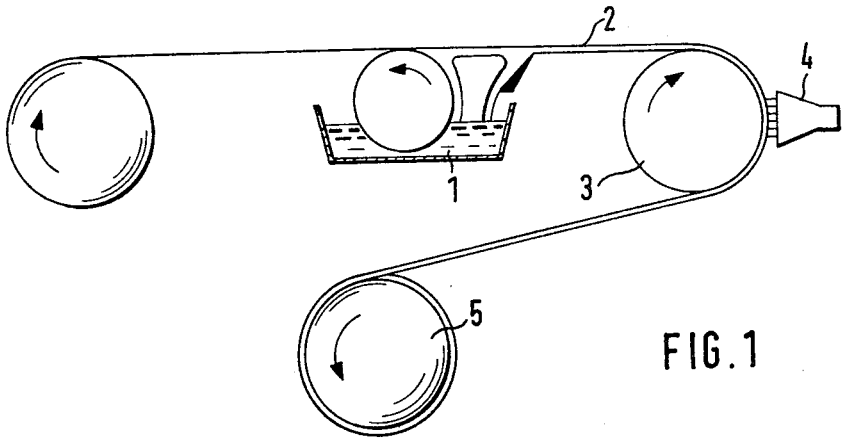
FIG. 1 is a side elevational view illustrating diagrammatically apparatus for coating paper with pigmented resin and for curing the resin.

In FIG. 1, the paper 2 coated on one side with the radiation-hardenable resin mixture 1 by means of a rotating cylinder, the thickness of the coating being controlled by a doctor blade. The paper is pressed with the coated side against a highly polished cylinder 3, is hardened by means of accelerated electron radiation 4 from the rear face of the paper, is separated from the cylinder and rolled up 5. The forming cylinder 3 is with advantage cooled with water in order to facilitate the removal. The cooling temperature is preferably equal to the dewpoint of the surrounding air.

The polymerization hardening of the resin coating is carried out in the absence of air by bombarding the surface of the paper with electrons from a cathode ray tube or similar generator having a thin titanium electron-transparent window. A suitable apparatus is sold under the trademark ELECTROCURTAIN by Energy Science, Inc. of Burlington, Massachusetts. This apparatus has an output of 200 KV to 500 KV at 100 milliamperes.

The paper, with a highly polished coating on one face, is also water-proof coated on its rear face in a further operation. The rear face coating may be applied in any known manner and be of any suitable material, provided that the necessary sealing of the paper against photographic developing baths is achieved. One possible method is conventional lacquering with physically drying lacquer or a melt coating, for example with polyethylene, or also coating with radiation-hardenable material and subsequent hardening.

In one special form of embodiment of the invention, the rear face may also be coated and hardened with electron radiation in one single operation together with the front face. Such a possibility is depicted diagrammatically in FIG. 2. The exposed face must be blanketed with an inert gas to ensure complete hardening of the preferred polyester resin coating, hereinafter described. It is furthermore possible to coat the two sides of the paper successively in one pass in a kind of tandem plant. In this method, the front face may first be coated followed by the rear face, or vice versa.

DETAILED DESCRIPTION

The forming cylinder used according to the present invention, the surface of which determines the quality of the coated paper surface, is preferably a polished and chromium-plated steel cylinder, which is internally cooled with water or some other coolant. Instead of a cylinder, it is also possible to use however an endless belt, for example of stainless steel as the forming material. Finally, it is also possible to utilize a previously produced co-running foil possessing the desired surface quality for forming the surface. It must, however, be accepted that the mechanical properties of a co-running foil deteriorate after being used several times as a consequence of the electron bombardment, and the foil must be replaced after a few cycles.

According to this invention, the mixtures that are hardenable by electron radiation used for the production of highly plane paper coatings consist of a hardenable binding agent and a pigment or pigment mixture. The hardenable binding agent consists essentially of organic polymerizable compounds, which contain C=C double bonds. The binder can, however, also contain smaller proportions of non-hardenable polymers or low-molecular constituents, provided such an addition is meaningful, for example for the purpose of improving the properties of the coating. These coatings do not require a chemical catalyst or initiator to effect the cure, which chemicals are harmful to the photographic emulsion subsequently applied to the coated paper. In order to obtain mar-resistant surfaces coatings which are also flexible, it has proved to be advantageous to use mixtures of di-unsaturated or poly-unsaturated prepolymers or low-molecular resins with di-unsaturated or poly-unsaturated (e.g. vinyl) monomers for the production of the coatings. But it is also possible to use alone multi-functional oligomeric or polymeric substances as pigment binders or to use alone hardenable monomers or to use a mixture of indifferent polymers with hardenable monomers.

Suitable commercially obtainable resins and prepolymers containing at least two C=C double bonds per molecule and having a molecular weight between 500 and 5000, and which can be hardened by radiation are:

- acrylic esters of aliphatic polyurethanes
- acrylic esters of terephthalic acid-diol (or-polyol-) polyesters
- acrylic esters of methylol melamine resins
- maleic acid diol polyester
- acrylic esters of bisphenol A epoxy resins
- unsaturated polyester resins
- styrene-butadiene copolymer resins
- acrylic acid esters of hydrolyzed starch or hydrolyzed cellulose
- fumaric acid diol polyester Suitable monomers that can be hardened by accelerated electron rays and are suitable for use according to this invention are:

- acrylic acid esters of mono-or polyhydric alcohols (e.g. hexane dioldiacrylate),
- methacrylic acid esters of mono-or polyhydric alcohols (e.g. hydroxy ethyl methacrylate),
- acrylic acid esters and methacrylic acid esters of ether alcohols (e.g. diglycol diacrylate),
- mono-, di-, tri-, tetra-, and pentaacrylates or methacrylates of polyfunctional alcohols (e.g. trimethylol propane triacrylate, neopentyl di(meth) acrylate, pentaerythritol triacrylate or others),
- cyanoethyl acrylate,
- glycidyl (meth) acrylate,
- allyl acrylate,
- cyclohexyl methacrylate,
- diallyl fumarate,
- divinylbenzene This is a preferential but by no means limiting selection, since in essence all radiation-polymerizing compounds could be used. Only highly volatile monomers are not preferred. Suitable resins and radiation-curing apparatus are described in U.S. Pat. No. 3,658,620.

Non-hardening resins which, for example, are added for flexibilizing or as bond promoter or for other reasons for the production of mixtures with unsaturated reactive resins, preferably have an average molecular weight of 1000–8000. They are preferably from one of the following groups:

cellulose esters,
polyvinyl butyral,
polyvinyl acetate and vinyl acetate copolymers,
styrene/acrylate copolymer resins,
polystyrene resins,
saturated and unsaturated styrene-free polyester resins.

The hardenable mixtures used for methods according to this invention for the production of coatings on paper can be pigment-free or contain pigments. Suitable white pigments and fillers are:

barium sulphate,
titanium dioxide (rutile and anatase),
calcium carbonate,
zinc sulphide,
metal silicates (e.g. aluminum silicate),
magnesium oxide,
aluminum oxide and hydroxide,
mixed oxides of titanium (e.g. magnesium titanate),
titanium phosphate
satin white,
silicon dioxide,
zinc oxide.

Additions of blue, violet and red shading dyes to white pigmented mixtures may be made to enhance the subjective impression of whiteness. The dyes may be added to compensate for a yellowish tint of the resin layer or any off-white tint of the photographic coatings. Inorganic pigments are commonly used, for example ultramarine, cobalt blue, cobalt violet, cadmium red and others, but also organic pigments (e.g. phthalocyanine blue) can equally well be used.

For special applications, larger quantities of more intensively coloring pigments may be mixed in, for example as anthihalo agents. Coated papers used especially for silver salt diffusion transfer processes contain carbon black or finely particulate graphite in the waterproof resin coating. Finally, completely opaque coatings can be produced by appropriately high additions of carbon black. Such papers are suitable particularly for use in so-called self-developing cameras.

The paper substrate to be coated according to this invention may be any photographic base paper, which is either neutrally sized with the use of alkyl ketone dimer or has a known acid sizing on a base of precipitated resin soaps, fatty acid soaps or fatty acid anhydrides. The papers also preferably have a sealing surface sizing of water-soluble or water-dispersible binders. The surface sizing may contain antistatically active substances according to German Patent 1 422 865 and also possibly pigments and/or water-repellent additives and/or coloring additives. The base paper may be made exclusively from cellulose fibres or from mixtures of cellulose fibres with synthetic fibres. It may have a weight of 60–250 g/m$^2$ (preferably 80–190 g/m$^2$) any may be either smooth or rough on its surface.

In the following examples, the principles of the present invention are explained in more detail by the use of a few model recipes. By comparative testing of the paper supports produced according to this invention and of a photographic paper support produced according to the state of the art (reference examples), the superiority of the paper supports produced according to the present invention is attested.

SPECIFIC EXAMPLES

EXAMPLE 1

A photographic base paper sized with the use of alkyl ketene dimer, which was given a surface sizing consisting of starch, maleic acid anhydride/styrene copolymer and sodium sulphate, and having a weight of approximately 160 g/m$^2$, was coated on one side with a pigmented, hardenable mixture. The composition of the coating mixture was:

30% by wt polyester acrylate (MW-approx. 1000, with 4 double bonds per molecule)*
30% by wt. hexane diol diacrylate
15% by wt. trimethylol propane triacrylate
25% by wt. titanium dioxide, rutile form, surface treated (mean particle diameter=approx. 0.2 μm).

*Sold as Ebecryl 970 by UCB S.A., Drogenbos, Belgium.

The quantity of coating applied was approximately 40 g/m$^2$. The coated paper was subsequently pressed with its coated face as shown in FIG. 1 against a cooled highly polished cylinder and hardened from the rear face of the paper by accelerated electron rays using an energy dose of 50 J/g. The forming cylinder was internally cooled by cold water throughout the entire operation.

After the hardening, the coated paper was removed from the cylinder, reeled up and, in a second operation, coated on the non-coated opposite side with approximately 40 g/m$^2$ of the same mixture. The coating was smoothed with a wiper bar and hardened under nitrogen by means of accelerated electrons using an energy dose of 50 J/g.

EXAMPLE 2

As in Example 1, an approximately 160 g/m$^2$ photographic base paper was coated on the front face with approximately 40 g/m$^2$ of a hardenable mixture. The composition of the coating mixture was:

20% by wt. polyester acrylate (MW-approx. 1000, with 4 double bonds per molecule), Ebecryl 270,
30% by wt. hexane diol diacrylate,
5% by wt. hydroxy ethyl acrylate,
45% by wt. titanium dioxide (rutile), (mean particle diameter=0.2 μm).

The coated paper was pressed as in Example 1 with its coated face against a cooled highly polished cylinder, was hardened as described by electron radiation, reeled up and subsequently coated on the reverse side with a like coating.

EXAMPLE 3

Corresponding to the method of Example 1, an approximately 130 g/m$^2$ photographic base paper was coated on the front face with approx. 33 g/m$^2$ of a carbon black-containing, hardenable mixture. The composition of the mixture was:

25% by wt. aliphatic polyurethane acrylate (MW=approx. 5000, with 2 double bonds per molecule), Ebecryl 270
50% by wt. hexane diol diacrylate,
25% by wt. carbon gas black (mean particle diameter=27 nm, BET surface=110 m$^2$g).

The coating was hardened as in Example 1 in contact with the highly polished drum with an energy dose of 50 J/g and separated from the forming face.

The rear face was then coated with approx. 35 g/m$^2$ of a white pigmented mixture. This mixture consisted of:

35% by wt. polyester acrylate (MW=approx. 1000, with 4 double bonds per molecule),
32% by wt. hexane diol diacrylate,
20% by wt. titanium dioxide (rutile, mean particle diameter=0.3 μm),
8% by wt. micronized silicic acid (mean particle diameter=3 μm),
5% by wt. butyl ester of phosphoric acid (mono butyl phosphate and dibutyl phosphate in approximately equal parts).

This layer was hardened as in the second operation of Example 1.

EXAMPLE 4

An approximately 80 g/m$_2$ photographic base paper was first coated on one face with approx. 30 g/m$^2$ of a hardenable mixture, which was pressed as in Example 1 against a highly polished cylinder and hardened from the uncoated side of the paper by means of electron rays with an energy density of 50 J/g. The composition of the coating mixture was:

5% by wt. polyvinyl butyral (MW=approx. 7000),
15% by wt. aliphatic polyurethane acrylate (MW=approx. 3000, with 2 double bonds per molecule),
15% by wt. pentaerythritol triacrylate,
30% by wt. 2-ethyl-propane diol-1,3-diacrylate,
37% by wt. titanium dioxide (rutile, mean particle diameter=0.2 μm),
3% by wt. carbon gas black (mean particle diameter=23 nm, BET surface-180 m$^2$g).

The reverse face was then coated with approx. 30 g/m$^2$ of a light-opaque, hardenable mixture, which was also pressed against a highly polished cylinder and hardened from the opposite face by means of electron rays with an energy dose of 50 J/g. The composition of this mixture was:

25% by wt. epoxy acrylate (MW=approx. 1500, with 4 double bonds per molecule)*
15% by wt. butane diol diacrylate,
15% by wt. polyethylene glycol-(400)-diacrylate,
5% by wt. phthalic acid polyester plasticizer,
25% by wt. carbon gas black (mean particle diameter=27 nm, BET surface=110 m$^2$/g),
15% by wt. titanium dioxide (rutile, mean particle diameter=0.2 μm).

*Synocure 3100, Cray Valley Products, Ltd., Orpington, England.

EXAMPLE 5

Figure 2:
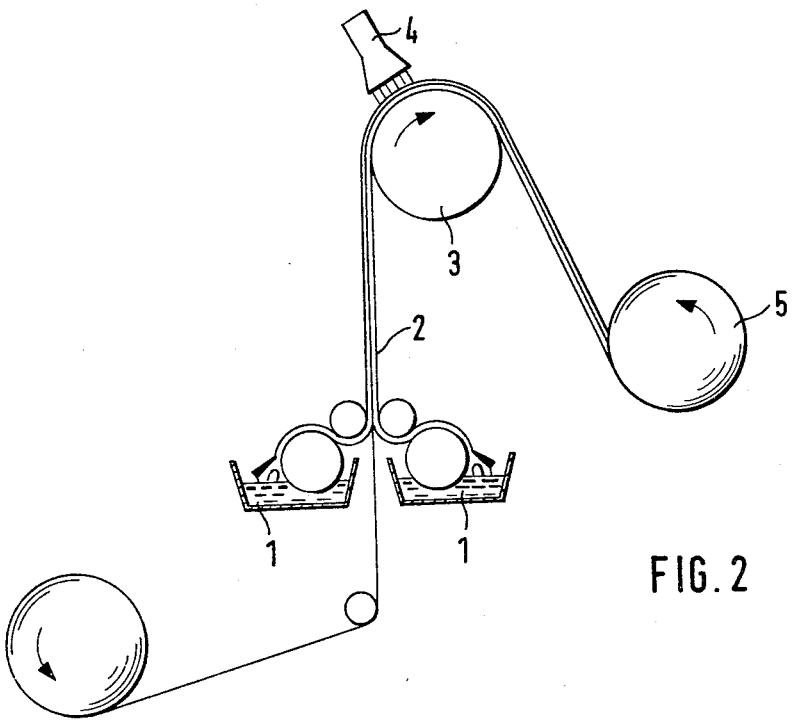
FIG. 2 is a similar view of similar apparatus for coating two sides of the paper.

In an installation according to FIG. 2, an approx. 170 g/m$^2$ photographic base paper was coated on both faces with 30 g/m$^2$ each of hardenable mixtures, was pressed with the white pigmented coating intended for the front face of the final product against a highly polished cylinder, and both the coatings were simultaneously hardened from the opposite face by means of electron rays under a nitrogen blanket with an energy dose of 50 J/g. The composition of the white coating mixture, bearing against the highly polished cylinder, was:

16% by wt. polyester acrylate (MW=approx. 1000, with 4 double bonds per moledule),
40% by wt. hexane diol diacrylate,
33.98% by wt. titanium dioxide (anatase, surface-treated, mean particle diameter=0.25 μm),
10% by wt. calcium carbonate (surface-treated with Ca-resinate, mean particle diameter=3 μm),
0.02% by wt. phthalocyanine blue.

The composition of the coating mixture on the exposed face towards the cathode ray tube was:

25% by wt. aliphatic polyurethane acrtlate (MW=approx. 5000, 2 double bonds per moledule),
65% by wt. hexane diol diacrylate,
10% by wt. micronized silicic acid (mean particle diameter=4 μm).

EXAMPLE 6

An approximately 160 g/m$^2$ photographic base paper was coated on one side as in Example 1 with a hardenable mixture. The quantity of coating applied was approx. 40 g/m$^2$. The coated paper was pressed with its coated face onto a highly polished polyester foil, was conducted together with this foil according to FIG. 1 around a roller and the coating was hardened from the rear side of the paper by means of electron rays with an energy dose of 50 J/g.

After hardening had been carried out, the coated paper was reeled up separately from the foil and coated on the rear face also in a second operation.

EXAMPLE 7

A coating composition prepared in accordance with Example 1 was coated in the amount of 20 g/m$^2$ on a base paper weighing approximately 100 g/m$^2$. Separate segments of the coated paper were cured against the chrome plated surface of a cylinder at various energy levels with the following results on the resin cure:

| Energy Level | Pressure on Cylinder | Result |
|---|---|---|
| 10 J/g | Light | Not quite hardened |
| 20 J/g | None | Hardened |
| 30 J/g | None | Hardened |
| 50 J/g | None | Hardened |
| 60 J/g | None | Hardened-Paper beginning to discolor |
| 80 J/g | None | Hardened-Paper distinctly scorched |
| 100 J/g | None | Hardened-Paper brittle |

These results indicate the preferred radiation ranges from 20 to 50 J/g under the test conditions.

REFERENCE EXAMPLE A

Following the teaching of Example 4 of German Patent 1 447 815, an approx. 160 g/m$^2$ photographic base paper was coated on the front face by extrusion coating with a film of low-density polyethylene (d=0.924 g/cm$^3$) containing 15% by wt. titanium dioxide. The surface weight of the polyethylene-titanium dioxide coating was approx. 38 g/m$^2$. The rear face of the thus coated paper was subsequently coated with approx. 38 g/m$^2$ of high-density polyethylene (d=0.963 g/cm$^3$).

REFERENCE EXAMPLE B

A photographic paper support coated according to reference Example A was smoothed (calendered according to DOS 22 50 063 (Example 1) under a pressure of 80 kg/cm$^2$ between metal rolls at a surface temperature of 50° C.

TESTING OF THE PHOTOGRAPHIC PAPER SUPPORTS

The photographic paper supports 1–6 produced according to this invention and the reference specimens were tested in regard to surface quality according to a procedure developed by ourselves for this purpose. In the case of polished surfaces, this testing procedure responds more sensitively to finer and coarser irregularities, which are termed "grain or pitting" or fine "denting". The process is based upon the determination of the deflection of a parallel beam of rays after being reflected at the more or less uneven, polished surface to be tested.

The measurement is carried out as follows. A light beam is passed through a line grating with defined line widths and line spacings, with a light beam incidence angle of 45°. A mirror image of the grating lines is produced on the surface to be tested, the latter being mounted on a platform which is moveable toward and away from the grating. The distance at which the lines of the grating can still be recognized as lines is determined. Measurement coefficients are obtained, which are related in percent to an ideally flat mirror surface. The higher the number, the closer the sample approaches the ideal surface. These measurement coefficients, which permit a very good comparative statement about the surface quality, are summarized for the paper supports produced according to this invention, for the reference specimens, for a conventional barytic paper, and for the forming foil used in Example 6, in the table given below. The table also contains, for a comparative evaluation, the results of the gloss measurement according to Gardner (according to TAPPI Standard T 480 os 72) and also the characterizing coefficients of the surface characteristic as they were established with a usual (surface-roughness detecting device according to DIN 4768. Oct. 1970, published by Deutschen Normenausschusses Berlin 30).

| | Gloss 75° According to Gardner | Surface Roughness (Din 4768) $R_z$ | $R_a$ | Surface Quality % of Ideal Flat Surface |
|---|---|---|---|---|
| Polyester foil | 80 | 1.7 | 0.6 | 96 |
| Conventional Barytic paper (glossy but not smooth) | 39 | 6.0 | 1.7 | 0 |
| Reference A | 92 | 2.2 | 0.9 | 12 |
| Reference B | 95 | 1.6 | 0.5 | 19 |
| Example 1 | 94 | 2.0 | 0.8 | 73 |
| Example 2 | 90 | 2.1 | 0.7 | 70 |
| Example 3 | 94 | 2.0 | 0.9 | 72 |
| Example 4, front face | 92 | 2.1 | 0.9 | 70 |
| Example 4, rear face | 90 | 2.1 | 0.8 | 74 |
| Example 5 | 90 | 2.5 | 0.9 | 70 |
| Example 6 | 93 | 1.9 | 0.7 | 82 |

The measurement results clearly show the superior surface quality of the papers produced according to this invention. The improvement becomes apparent especially as compared with the state of the art represented by referenced A and B.

For the purpose of carrying out further testing, support papers of examples 1–6 and of reference examples A and B and also the commercially available polyester foil were subjected in known manner to a corona treatment and coated with a solution of the following composition:

5% by wt. photographic gelatine,
0.4% by wt. p-chlorophenol,
0.5% by wt. of 5% saponin solution,
84.1% by wt. desalinated water,
5% by wt. isoproanol,
5% by wt. butanol,
Ammonia solution to pH=8.4.

After this coating had been dried, a thin layer of approx. 0.7 g/m$^2$ remained on the various supports. This layer was then coated with a usual black-and-white silver halide coating. The subsequent photographic testing yielded, in all test specimens, comparable good results in respect of sensitivity, contrast, photographic density and fogging.

All the materials were also tested for planeness under various atmospheric conditions and for electrostatic charging that occurred with contact of the test sheets and subsequent separation. All the coated papers exhibited a satisfactory planeness and, except for polyester foil, only slight electrostatic charging.

Other test pieces of examples 3 and 4, coated as above with a gelatine bond-promoting coating, were coated with a conventional emulsion layer for silver salt diffusion processes. The thus obtained photographic materials were processed together with commercially available positive material and developer for instant image in a simplified instant image camera. Exposure was carried out to a medium grey shade followed by development and susequently the cloudy disturbance ("mottle") in the grey surface was comparatively assessed. In the result, the reference samples clearly exhibited "mottle", whereas the test sheets produced according to this invention were free from "mottle". With this test result, the association between the surface quality determined by means of the described special testing procedure and the photographic "mottle" becomes clear, and the improvement which is decisive for photographic purposes in the surface quality can be recognized in its practical significance.

We claim:

1. Method for making a waterproof photographic paper support which comprises:

(a) coating at least one surface of a sized photographic base paper with a pigment-coating resin hardenable by radiation, with resin comprising acrylatemodified mixtures of organic resins containing c=c double bonds, (b) pressing the resin coated surface against a substantially solid high gloss surface, (c) bombarding the surface of the paper opposite the coated surface with sufficient electrons to substantially completely harden the resin while the resin is in contact with said high gloss surface; and (d) separating the substantially completely cured coated surface from said high gloss surface to form a waterproof paper support having a surface smoothness which is at least 70% that of an ideal flat mirror surface, as measured by an image reflected from said hardened, coated surface.

2. The method of claim 1 in which the method is carried out continuously while maintaining the temperature of the high gloss surface at a temperature not higher than the dew point of the ambient atmosphere.

3. The method of claim 1 in which the electron bombardment attains an energy level of about 50 joules per gram of resin being hardened.

4. The method of claim 2 in which both surfaces of the paper are coated with the same resin and the exposed surface is blanketed with inert gas to exclude oxygen during the hardening step.

5. The method of claim 1 in which the resin is an organic unsaturated acrylic ester.

6. The method of claim 1 in which the resin is an organic unsaturated polyester prepolymer in admixture with a vinyl monomer.

7. The method of claim 1 which includes the additional step of applying a pigmented thermoplastic resin coating to the opposite side of said base paper.

8. The method of claim 1 in which the pressure applied to the coated paper is from 10 to 1000 grams/centimeter.

9. The method of claim 2 in which the pressure applied to the coated paper is from 100 to 500 grams/centimeter.

10. In a method for the production of a high gloss waterproof photographic paper having a coating thereon of a composition consisting of coloring agents and hardenable resins, said method including the steps of coating at least one surface of a sized photographic base paper with said composition, pressing the coated surface of said paper against a substantially solid high gloss surface, bombarding the exposed surface of the paper with electron radiation to harden the composition while in contact with said high gloss surface, and separating the hardened product from the high gloss surface, the improvement comprising, in combination:

(a) cooling said substantially solid high gloss surface to a temperature not higher than the dew point of the surrounding atmosphere; while (b) applying sufficient pressure through the coated surface of the paper against the substantially solid high gloss surface to produce substantially bubble-free contact between said coated surfaces and said high gloss surface.

11. The improved method of claim 10 wherein the high gloss surface is cooled to a temperature below the dew point of the surrounding atmosphere.

12. The improved method of claim 10 wherein the pressure applied through the coated paper is between about 10 and about 1000 grams/centimeter.

13. The improved method of claim 12 wherein the pressure applied through the coated paper is between about 100 and about 500 grams/centimeter.

* * * * *